United States Patent [19]

Hussey

[11] Patent Number: 4,704,563

[45] Date of Patent: Nov. 3, 1987

[54] FLUORESCENT LAMP OPERATING CIRCUIT

[75] Inventor: Sam W. Hussey, Lakewood, Ohio

[73] Assignee: General Electric Company, Schenectady, N.Y.

[21] Appl. No.: 861,907

[22] Filed: May 9, 1986

[51] Int. Cl.[4] ..... H05B 37/02; H05B 39/04

[52] U.S. Cl. ..... 315/307; 315/101; 315/105; 315/293; 315/DIG. 2; 315/DIG. 4; 315/DIG. 5; 315/DIG. 7; 315/175

[58] Field of Search ..... 315/101, 105, 307, DIG. 2, 315/DIG. 4, DIG. 5, DIG. 7, 293, 174, 175, 107

[56] References Cited

U.S. PATENT DOCUMENTS

| | | | |
|---|---|---|---|
| 3,987,356 | 10/1976 | Steigerwald | 321/10 |
| 4,017,785 | 4/1977 | Perper | 321/4 |
| 4,074,344 | 2/1978 | Pitel | 363/44 |
| 4,109,307 | 8/1978 | Knoll | 363/101 |
| 4,188,660 | 2/1980 | Knoll | 363/49 |
| 4,222,096 | 9/1980 | Capewell | 363/44 |
| 4,392,087 | 7/1983 | Zansky | 315/DIG. 4 |
| 4,395,659 | 7/1983 | Aoike et al. | 315/209 R |
| 4,437,040 | 3/1984 | Bay | 315/DIG. 4 |
| 4,523,128 | 6/1985 | Stamm et al. | 315/DIG. 4 |
| 4,612,479 | 9/1986 | Zansky | 315/DIG. 4 |

*Primary Examiner*—David K. Moore
*Assistant Examiner*—Michael J. Nickerson
*Attorney, Agent, or Firm*—John P. McMahon; Philip L. Schlamp; Nathan D. Herkamp

[57] ABSTRACT

A fluorescent lamp operating circuit includes a high frequency electronic ballast circuit for providing a controlled output to a fluorescent lamp load. A control signal is detected from the power line carrier which includes binary data indicative of the illumination level desired. The control signal comprises a multi-bit binary signal which is detected by the control circuit and used to control the frequency of the power supply circuit so that the fluorescent light illumination level may be dimmed over a wide range.

4 Claims, 3 Drawing Figures

FLUORESCENT LAMP OPERATING CIRCUIT

BACKGROUND OF THE INVENTION

1. Field of the Invention

The present invention relates to fluorescent lamp operating circuits and, more particularly, to an electronic fluorescent lamp operating circuit for starting and operating a fluorescent lamp load at a controllable output level.

2. Description of the Prior Art

Presently, fluorescent lamp operating circuits for providing variable illumination levels from fluorescent lamps have involved the use of chopping circuitry to limit the overall electrical power delivered to the fluorescent lamp. Such circuits employ high frequency signals during a portion of the a-c power wave, which create electromagnetic interference having a deleterious effect upon the operation of electronic equipment located in the vicinity of the ballast circuit or lamps and low power factor. The prior art fluorescent lamp control circuits provided dimming of the level of illumination by dissipating the energy within the power supply circuitry. This created heat which had to be dissipated from the system and resulted in substantial inefficiencies in terms of light output versus electrical power input.

SUMMARY OF THE INVENTION

An object of the present invention is to provide a fluorescent lamp operating circuit which allows reliable starting of fluorescent lamps and controllable operation of the fluorescent lamps at a variety of illumination levels without reducing the overall lighting system efficiency. A more specific object of the present invention is to provide an electronic ballast circuit including control signal detection circuitry for receiving control signals transmitted over the power line and adjusting the light output according to the information contained in the control signal.

Accordingly, the present invention includes a bridge circuit for converting a standard frequency power signal into a d-c input, an inverter circuit for converting the output of the d-c signal to a high frequency a-c wave for providing power to a fluorescent lamp load, an electrode heating control circuit for controlling the application of heating current to the lamp electrodes, an input control circuit for controlling the switching frequency of the transitors of the inverter circuit, a receiver circuit for receiving high frequency control signals from the power line and decoding binary messages from the control signals for providing control of the switching frequency, and a power transformer for supplying high frequency lamp operating power to the fluorescent lamp load including an auxiliary starting circuit for applying a starting voltalge to the load after preheat of the fluorescent lamp filament by an auxiliary power circuit.

BRIEF DESCRIPTION OF THE DRAWINGS

Further objects and advantages of the present invention together with its organization, method of operation and best mode contemplated may best be understood by reference to the following description taken in conjunction with the accompanying drawings in which.

DESCRIPTION OF THE PREFERRED EMBODIMENTS

Figure 1:
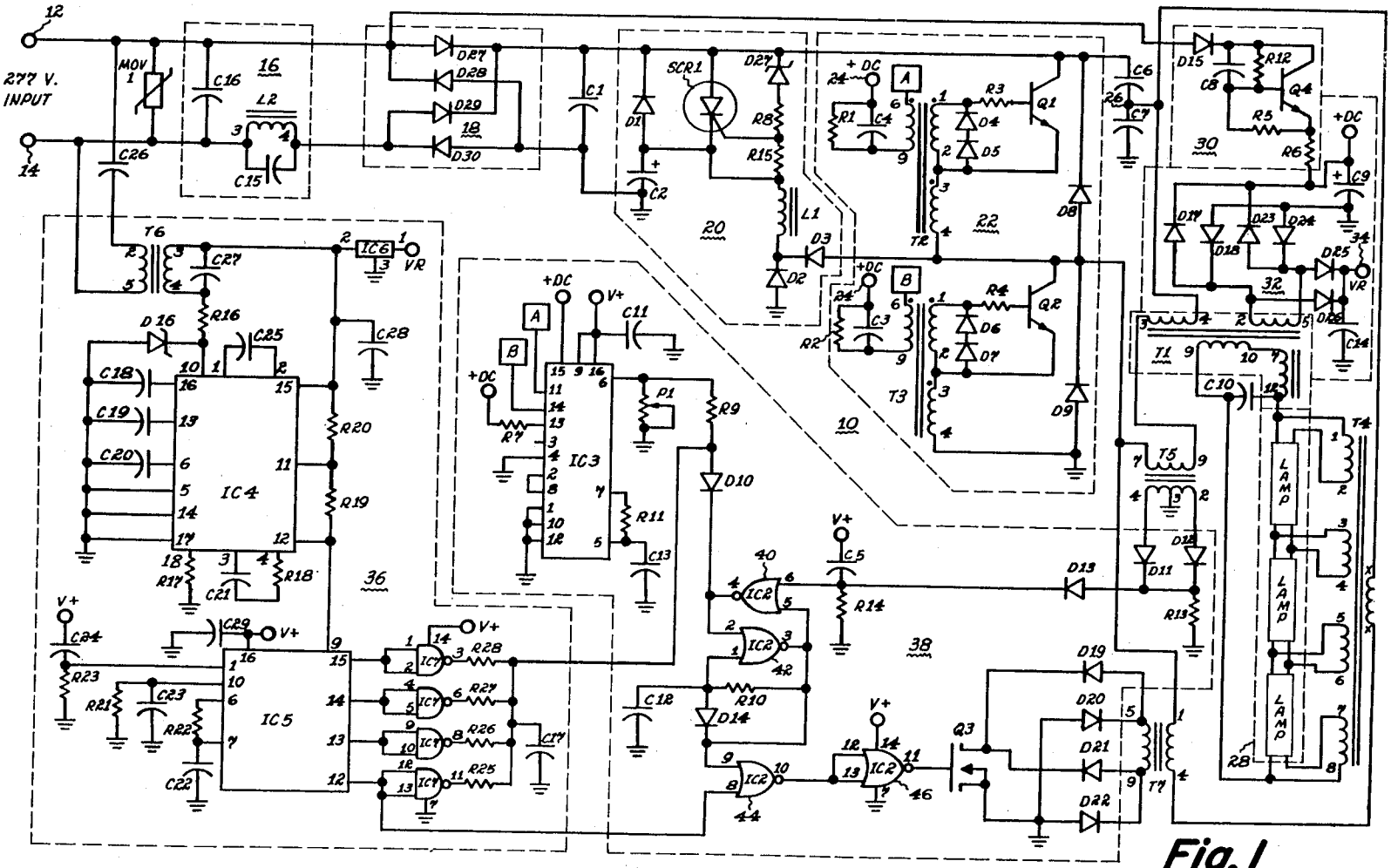
FIG. 1 is a schematic circuit diagram illustrating the fluorescent lamp operating circuit of the present invention; and FIGS. *2a* and *2b* are schematic timing diagrams illustrating the input control signals of the circuit diagram of FIG. 1.

The fluorescent lamp operating circuit 10 of the present invention, as shown in FIG. 1, includes input terminals 12 and 14 for connection to a power supply system having a signal generating and transmitting means attached to it for providing control signals to the operating circuit 10. Such a signal generating and transmitting system is disclosed in U.S. patent application Ser. No. (LD 9607) filed concurrently herewith by William M. Rucki and assigned to the present assignee which discloses and claims a system for providing to a power line carrier control signals of the character utilized by the fluorescent lamp operating circuit of the present invention. The circuit 10 of the present invention includes a notch-filler 16 including capacitor C16, inductor L2 and capacitor C15 connected as shown in the FIG. 1. The output of the notch filter is provided to a bridge rectifier circuit 18 including the four diodes D27, D28, D29 and D30. The bridge rectifier 18 supplies via capacitor C1 a rectified d-c signal to the power factor correction circuit 20 which includes diodes D1, D2, D3, zener diode D27, resistors R8 and R15, SCR1, inductor L1 and capacitor C2 a shown in the FIG. 1 connected to ground. The output of the power factor correction circuit 20 is supplied to an inverter switch circuit 22 which includes transistor Q1 supplied from transformer T2 connected to a d-c power supply at the terminal 24 via resistor R1 and capacitor C4 and connected to the transistor Q1 via diodes D4 and D5 and resistor R3 connected as shown with diode D8 connected across the output of transistor Q1; and transistor Q2 supplied from transformer T3 having its primary winding supplied from the d-c source 24 via resistor R2 and capacitor C3 and having a second winding connected via diodes D6 and D7 and resistor R4 to the base of transistor Q2 as shown, with diode D9 connected across the output of the transistor Q2. The inputs to the transformers T2 and T3 are controlled by the outputs of IC3 connected respectively at points A and B to be described hereinafter. The transistors Q1 and Q2 are connected in a half bridge arrangement with capacitors C6 and C7 as shown. The output from the junction 26 between capacitors C6 and C7 is supplied to the primary winding of transformer T1 whose secondary winding supplies power to the lamp load 28 across capacitor C10. Also connected to the junction point 26 is a primary winding of the transformer T4 whose secondary windings are connected to the respective terminals of the lamps of the lamp load 28 to provide preheating current to the lamp electrodes to assist in starting the lamps. The numerals shown on the drawing at the respective ends of the transformer windings are pin numbers for the electronic components comprising the elements shown schematically in FIG. 1. The input from the notch filter 16 is also connected to a bootstrap circuit 30 including diode D15 resistors R5, R6, and R12, capacitor C8 and transistor Q4 connected as shown in FIG. 1. The output of the bootstrap circuit 30 is connected to a power supply circuit 32 which includes a transformer winding on the transformer T1 to operate as a secondary and includes diodes D17, D18, D23, D24, D25 and D26; and capacitors C9 and C14 connected as shown in FIG. 1 to provide a reference voltage at output terminal 34 for the control circuit to be described hereinafter. A receiver circuit 36 is also connected to the input terminals 12 and 14 via blocking capacitor C26 and transformer T6 having capacitor C27 connected across its output terminals. Integrated circuit IC4 is connected to transformer T6 via resistor R16 at pin 10 and to capacitors C18, C19, C20, C21 and C25, resistors R17, R18, R19 and R20 and zener diode D16 at the respective pins as shown in FIG. 1. Integrated circuit IC4 is connected to pin 2 of IC6 with filter capacitor C28 connected thereto and IC6 is connected at pin 1 to the reference voltage output 34 of the power supply circuit 32. Integrated circuit IC5 is connected to pin 12 of IC4 and has resistors R21, R22, R23, and capacitors C22, C23, C24 and C29 connected to respective pins thereof as shown in FIG. 1. The outputs from pins IC5 at 12, 13, 14 and 15 of IC5 are provided to the respective pins 1, 2, 4, 5, 9, 10, 12 and 13 on integrated circuit IC7, for the respective gates connected thereto having respective resistors R25, R26, R27 and R28 connected to the output pins 3, 6, 8 and 11, respesctively, thereof with filter capacitor C17 connected to the opposite side of each of the respective resistors R25–R28. A control circuit 38 includes integrated circuit IC3 for providing the control signals A and B for the inverter switch circuits and has resistors R7, R9 and R11, potentiometer P1 and capacitors C11 and C13 connected thereto as shown in FIG. 1. The control circuit 38 also includes logic gates 40, 42, 44 and 46 disposed on an additional integrated circuit IC2 resistors R10, R12, capacitors C5, C12, didoes D10, D11, D12, D13, D14, transistor Q3 and diodes D19, D20, D21 and D22 connected to the primary winding of transformer T7 whose secondary winding is connected in series with the primary winding of the preheat transformer T4 to provide a control signal to the preheat circuits for controlling the application of preheating current to the lamp electrodes. The secondary winding of transformer T5 is connected electrically in series with the primary winding of transformer T1 and has a center tapped primary winding connected to the diodes D11 and D12 as shown in the figure to provide a control signal to turn on electrode heat when the lamps are started.

The fluorescent lamp operating circuit illustrated in FIG. 1 operates as follows. Upon application of a-c power, for example 277 volt a-c input at the terminals 12 and 14, the bootstrap circuit 30 provides a power signal to the power supply circuit 32 which generates a d-c reference voltage signal which is applied to the receiver circuit at IC6. This then generates pluses at A and B of 38 firing Q1 and Q2 of 22 which generates a voltage on power supply 32 from transformer T1. The bridge rectifier provides a d-c signal to circuit 20 and the power factor correction circuit 20 supplies a d-c power signal to the inverter switch circuit 22 when the 277 volt a-c signal is near zero voltage. The output of the inverter switch circuit 22 at terminal 26 feeds the primary winding of the transformer T1 and the primary of transformer T4. The transformer T4 which has a plurality of secondary windings connected to the respective filaments at the ends of the respective fluorescent lamps to preheat the windings to emissive temperatures. The output at terminal 26 also feeds the primary windings of transformers T1 and T5. The secondary windings of transformers T5 provides an output signal via diodes D11 and D13 to gate 40 which forces A and B to go to a high frequency (65 KHz) when there is an overload condition on Q1 and Q2. With either input of gate 44 going low, the output of 46 goes high which turns on transistor Q3 to apply a voltage to the primary winding of transformer T7 to allow current flow through the primary winding of transformer T4. The output of the transistors Q1 and Q2 is at a frequency of approximately 65 kilohertz and the component values of capacitors C10 and the inductances of the secondary winding of the transformer T1 and the auxilary winding L7–12 are selected so that at resonance C10 applies a high voltage across the series connected lamps to initiate the arc and therefore start the lamps. To initiate the arc, the frequency is reduced to 40 KHz which is the resonant frequency of the combination of C10 and the secondary winding and auxiliary winding of transformer T1.

Figure 2A:
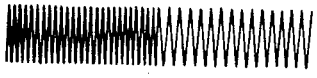
Figure 2B:
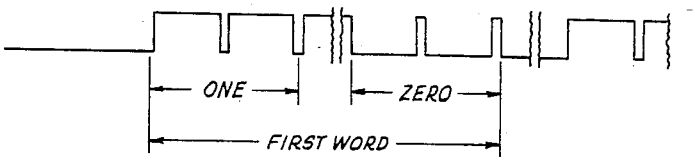

A multi-bit binary control signal shown in FIG. 2*a* is transmitted over the power line as a high frequency, e.g. 125 KHz center frequency, signal and is received at the input transformer T6. The secondary winding of transformer T6 and capacitor C27 form a tuned circuit at the data transmission frequency so that the data signal is transmitted to the integrated circuit IC4 which detects the binary signal and provides the series multi-bit data signal shown in FIG. 2*b* to the decoder IC5. IC5 decodes the input signal, stores the decoded data in memory and decodes the next data signal and compares the two data values. If two consecutive data values are equal IC5 translates the data into a multi-bit parallel binary output signal which is supplied via the gates on IC7 to IC3 to cause integrated circuit IC3 to provide output frequency control signals A and B to the windings of transformers T2 and T3 to control the switching frequency of transistors Q1 and Q2. In a sample circuit constructed as shown in FIG. 1, IC4 was a LM1983 frequency shift key transciever sold by National Semiconductor and IC3 was a PWM Controller UC 3525 of Unitrode. Capacitor C18 is a 60 Hz filter, and capacitors C19 and C20 are filter capacitors. Resistor R17 and capacitor C25 set the center frequency of the voltage controlled oscillator on IC 4. Resistor R18 and capacitor C21 comprise a phase locked loop filter and set the system a-c gain. Resistor R19 ia a pull-up resistor on an open collector and resistor R20 is a bias resistor for a transistor on IC4. When a data signal is received by IC4, the frequency modulated data shown in FIG. 2*a* is decoded into a serial binary data word and outputted at pin 12 of IC4 to serial input decoder IC5, e.g. a MC145027 sold by Motorola. IC5 has resistors R21, R22 and capacitors C23 and C22 connected as shown to set the detection characteristics of IC5. IC5 detects a five bit address code and if the address is correct, the four data bits are decoded and stored in a data register on IC5 for comparison with the successive data word. It two successive data words agree, a control signal of four parallel bits is transmitted to IC7, e.g. a nand chip 74LS03 sold by Texas Instruments. Binary zeroes in the parallel data word cause a current increase through resistor R9 to cause the frequency outputs of IC3 to vary at A and B. The frequency shift at A and B on transformers T2 and T3 shifts the switching frequency of transistors Q1 and Q2 to vary the voltage across capacitor C10 and therefore the intensity of light output from lamps in the load 28.

I claim:

1. An operating circuit for supplying and applying electrical power present on a power line to a fluorescent lamp load with the fluorescent lamp having electrodes, said operating circuit comprising:

input means for receiving an a-c electrical power signal;

rectifier means for converting said a-c power signal to a d-c power signal;

controllable electrode heating current supplying means for supplying electrode heating current to the lamp electrodes, and responsive to frequency controlled power switching means;

controllable fluorescent lamp starting means for applying a starting voltage to a fluorescent lamp load and responsive to said frequency controlled power switching means;

said frequency controlled power switching means controlling said electrode heating current and said lamp starting means being connected to the output of said rectifier means for converting said d-c power signal to a high frequency electrical signal for; (1) supplying electrical power to the lamp load during normal operation of said fluorescent lamp; (2) supplying said heating current; and (3) supplying said starting voltage;

communication circuit means for receiving frequency modulated binary control signals transmitted over said power line and translating said binary control signals into variable current control signals dependent upon the value of said binary control signals; and control circuit means for receiving said variable current control signals and providing frequency control signals to said high frequency power controlled switching means for controlling the switching frequency of said power switching means dependent upon said value of said binary control signals.

2. The operating circuit according to claim 1 wherein said frequency controlled power switching means comprises:

first and second bipolar power transistor means connected in a half bridge arrangement to said output of said rectifier means;

first and second frequency controlled drive transformer means connected respectively to the base terminals of said first and second power transistor means for controlling the switching frequency of said first and second transistor means.

3. The operating circuit according to claim 2 wherein said control circuit means comprises:

integrated circuit current controlled oscillator means for receiving said variable current control signals and providing said frequency control signals whose frequency depends upon the current value of said current control signals to said first and second drive transformer means.

4. The operating circuit according to claim 3 wherein said communication circuit means comprises:

high frequency coupling transformer means for receiving said binary control signals translated from said power line;

frequency shift key transceiver means for detecting said frequency binary modulated control signals and translating said frequency modulated binary control signals into a serial binary data word; and current control gate means for converting said binary data words into current control signals having a current level dependent upon the value of said binary control signals.

* * * * *